US008277237B1

(12) United States Patent
Cherish

(10) Patent No.: US 8,277,237 B1
(45) Date of Patent: Oct. 2, 2012

(54) ELECTRICAL PLUG HAVING RETRACTABLE PRONGS

(76) Inventor: Nicholas Cherish, South Park, PA (US)

( * ) Notice: Subject to any disclaimer, the term of this patent is extended or adjusted under 35 U.S.C. 154(b) by 269 days.

(21) Appl. No.: 12/754,131

(22) Filed: Apr. 5, 2010

(51) Int. Cl.
*H01R 29/00* (2006.01)

(52) U.S. Cl. ..... 439/172; 439/131

(58) Field of Classification Search ..... 439/131, 439/171–173, 140, 141
See application file for complete search history.

(56) References Cited

U.S. PATENT DOCUMENTS 2,229,150 A * 1/1941 Wadsworth ..... 439/172
2,538,296 A * 1/1951 Crocker ..... 439/172
2,796,591 A * 6/1957 Carter et al. ..... 439/172
3,575,684 A 4/1971 McIntyre
4,445,739 A 5/1984 Wooten
5,518,411 A 5/1996 Belleci
6,062,881 A 5/2000 Ellison
6,062,884 A * 5/2000 Messimer et al. ..... 439/172
6,231,358 B1 5/2001 Kerr et al.
6,382,996 B1 * 5/2002 Eyman ..... 439/172
D460,049 S 7/2002 McCoy
7,895,767 B2 * 3/2011 Harshbarger et al. ..... 33/836

* cited by examiner

*Primary Examiner* — Tho D Ta
(74) *Attorney, Agent, or Firm* — Kyle Fletcher

(57) ABSTRACT

The improved electrical plug includes electrical prongs that extend and retract into the housing via actuating means comprising a twisting action or a sliding tab. A twisting embodiment extends and retracts into the housing via a twisting action about a portion of the housing. A sliding tab embodiment includes a sliding tab located on a side of the housing that when moved up or down will extend or retract the prongs out of or into the housing, respectively. Either embodiment can be integrated into the design of an electrical cord or as an after-market product that is installed upon an electrical cord.

9 Claims, 3 Drawing Sheets

ELECTRICAL PLUG HAVING RETRACTABLE PRONGS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present, invention relates to the field of electrical plugs, more specifically, an electrical plug wherein the prongs extend and retract from within the housing.

B. Discussion of the Prior Art

As a preliminary note, it should be stated that there is an ample amount of prior art that deals with electrical plugs, generally. As will be discussed immediately below, no prior art discloses an electrical plug have retractable prongs that are actuated by a sliding tab or a twisting motion of the cover.

The Kerr, Jr. et al. Patent (U.S. Pat. No. 6,231,358) discloses an electrical plug connector in which the prongs are covered by a sheath or a cover that retracts when the prongs are pushed into an outlet. However, the electrical plug connector uses a spring-loaded cover to retract from the prongs as opposed to prongs that extend and retract from the cover.

The Ellison Patent (U.S. Pat. No. 6,062,881) discloses an electrical plug that has retractable blade covers to protect the prongs when not in use. Again, the cover extends to cover the prongs when not in use as opposed to prongs that move in and out of the cover.

The Wooten Patent (U.S. Pat. No. 4,445,739) discloses a male power plug connector that has a retractable prong cover. Again, the cover extends to cover the prongs when not in use as opposed to prongs that move in and out of the cover.

The Belleci Patent (U.S. Pat. No. 5,518,411) discloses a power plug connector that has prong blades that are spring-loaded and will retract into the tip of the connector when not in use. However, the prong blades are spring-loaded and move the cover upon use of the connector as opposed to prong blades that extend or retract from the cover upon movement of a sliding tab or rotational movement of a portion of the cover.

The McIntyre Patent (U.S. Pat. No. 3,575,684) discloses a safety power plug connector in which the prongs are covered when not in use and a sheath will retract when the prongs are inserted into an outlet. However, the safety power plug connector uses spring-biased insulating sheaths that extend and retract from the housing to reveal or cover the prongs.

The McCoy Patent (U.S. Pat. No. Des. 460,049) illustrates a design for an electrical power connector in which the prongs are covered, which does not depict movement of the prongs into or out of the cover.

While the above-described devices fulfill their respective and particular objects and requirements, they do not describe an electrical plug have retractable prongs that are actuated by a sliding tab or a twisting motion of the cover. In this regard, the improved electrical plug departs from the conventional concepts and designs of the prior art.

SUMMARY OF THE INVENTION

The improved electrical plug includes electrical prongs that extend and retract into the housing via actuating means comprising a twisting action or a sliding tab. A twisting embodiment extends and retracts into the housing via a twisting action about a portion of the housing. A sliding tab embodiment includes a sliding tab located on a side of the housing that when moved up or down will extend or retract the prongs out of or into the housing, respectively. Either embodiment can be integrated into the design of an electrical cord or as an after-market product that is installed upon an electrical cord.

It is an object of the invention to provide an improved electrical plug wherein the electrical prongs extend or retract from the housing via actuating means.

A further object of the invention is to provide actuating means comprising a twisting motion or a sliding tab design to actuate the prongs in and out of the cover.

A further object of the invention is to provide an improved electrical plug that is integrated into the design of an electrical cord or as an after-market kit that can be installed upon an existing electrical cord.

These together with additional objects, features and advantages of the improved electrical plug will be readily apparent to those of ordinary skill in the art upon reading the following detailed description of presently preferred, but nonetheless illustrative, embodiments of the improved electrical plug when taken in conjunction with the accompanying drawings.

In this respect, before explaining the current embodiments of the improved electrical plug in detail, it is to be understood that the improved electrical plug is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the improved electrical plug.

It is therefore important that the claims be regarded as including such equivalent construction insofar as they do not depart from the spirit and scope of the improved electrical plug. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
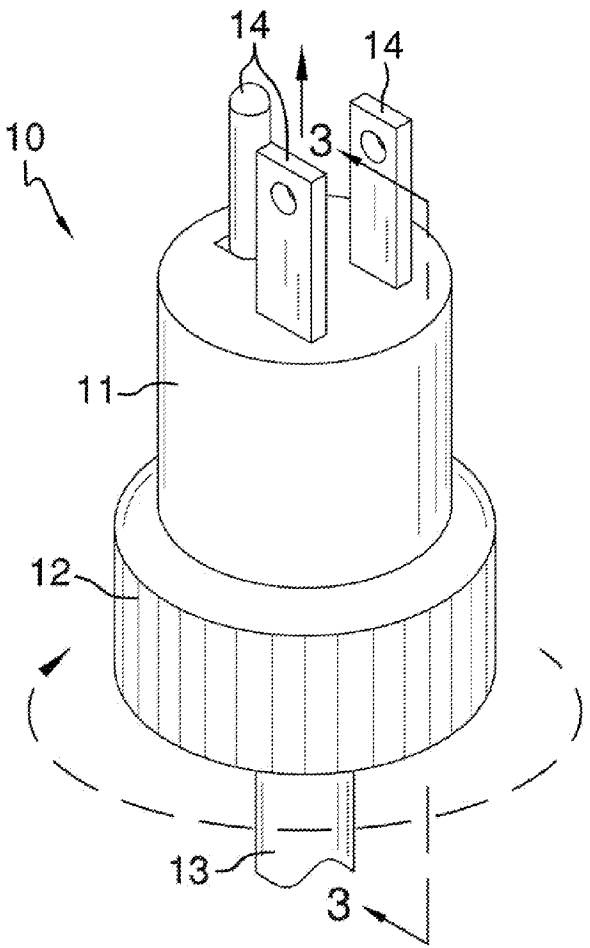
FIG. 1 illustrates an isometric view of a twisting embodiment of the invention wherein upon twisting of the base of the cover will extend or retract the prongs from or into the cover.
Figure 3B:
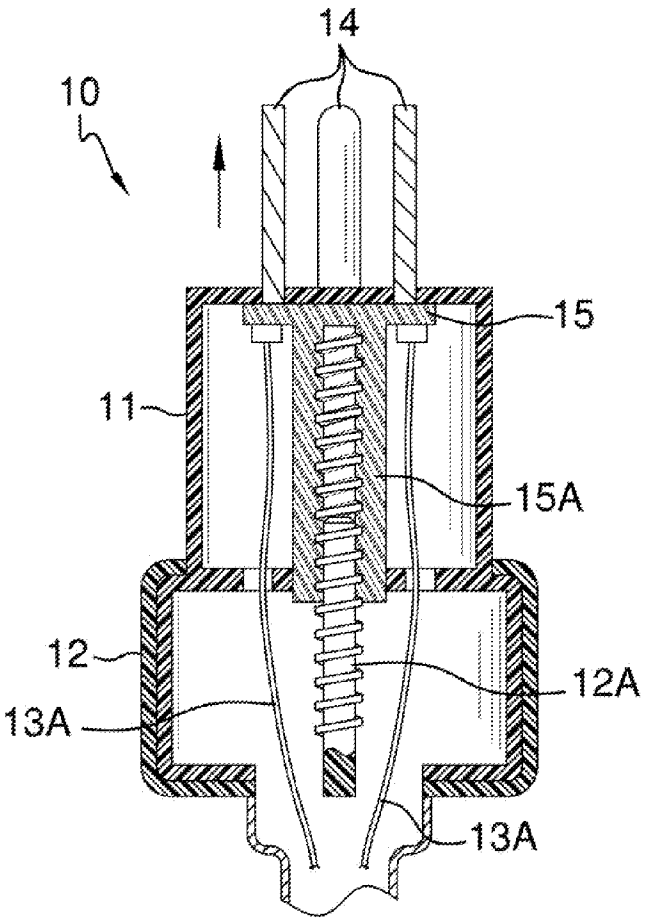
FIG. 3B illustrates a cross-sectional view of the twisting embodiment in FIG. 1, and depicting the prongs in an extended state.
Figure 3A:
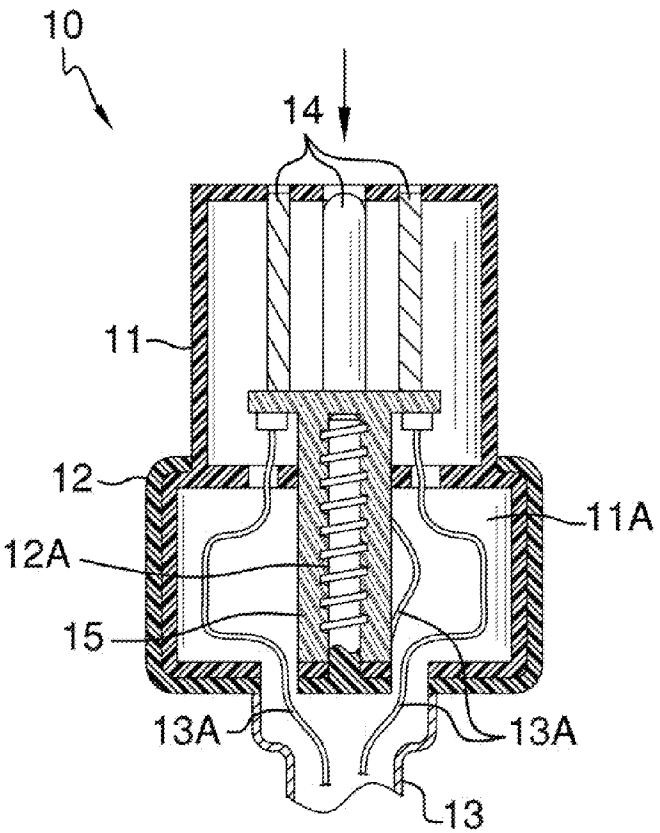
FIG. 3A illustrates a cross-sectional view of the twisting embodiment in FIG. 1, and depicting the prongs in a retracted state.

Detailed reference will now be made to the preferred embodiment of the present invention, examples of which are illustrated in FIGS. 1, 3A, and 3B. A twisting embodiment 10 includes a top housing 11, a bottom housing 12, an electrical cord 13, and a plurality of electric prongs 14 (hereinafter prongs).

It is important to note that the electrical prongs 14 are in electrical connection with the electrical cord 13 via individual wires 13A that run from the respective prong 14 and of which travel the length of the electrical cord 13.

The bottom housing 12 and the top housing 11 are both cylindrical in shape. The top housing 11 has a chamber 11A that extends to within the bottom housing 12. In other words the bottom housing 12 encompasses the chamber 11A of the top housing 11. The bottom housing 12 can rotate about both the top housing 11 and the chamber 11A of the top housing 11.

The prongs 14 are mounted onto a mounting plate 15, which is located within the chamber 11A, the top housing 11, and the bottom housing 12. The mounting plate 15 has a female member 15A that extends away from the prongs 14. The female member 15A extends inside of the chamber 11A.

Located within the bottom housing 12 is a spiraling screw 12A. The spiraling screw 12A is centrally located about the bottom housing 12, and extends to within the chamber 11A of the top housing 11. When the bottom housing 12 is rotated about the top housing 11, the spiraling screw 12A rotates with respect to the chamber 11A and the top housing 11.

The spiraling screw 12A has external threads that corresponds with internal threads located on the female member 15A of the mounting plate 15. However, the mounting plate 15 and the female member 15A move in unison, and cannot rotate at all. The mounting plate 15 and the female member 15A are capable of vertical movement inside of both the top housing 11 and the bottom housing 12. In sum, as the bottom housing 12 is rotated, the external threads of the spiraling screw 12A (depending upon rotation) enter and exit the internal threading of the female member 15A, which causes vertical movement of the mounting plate 15. Thus, upon rotation of the bottom housing 12, the prongs 14 extend or retract from the top housing 11.

It shall be noted that the wires 13A will move up and down with the mounting plate 15 and extend and retract into the chamber 11A.

It shall be further noted that the mounting plate 15 has a limited range of movement defined by inner surfaces of the top housing 11, which act as stops to the rotational movement of the twisting embodiment.

The top housing 11, the bottom housing 12, the mounting plate 15, the female member 15A, the spiraling screw 12A, and the chamber 11A are made of a material comprising a metal, plastic, carbon fiber composite, or a wood.

Figure 2:
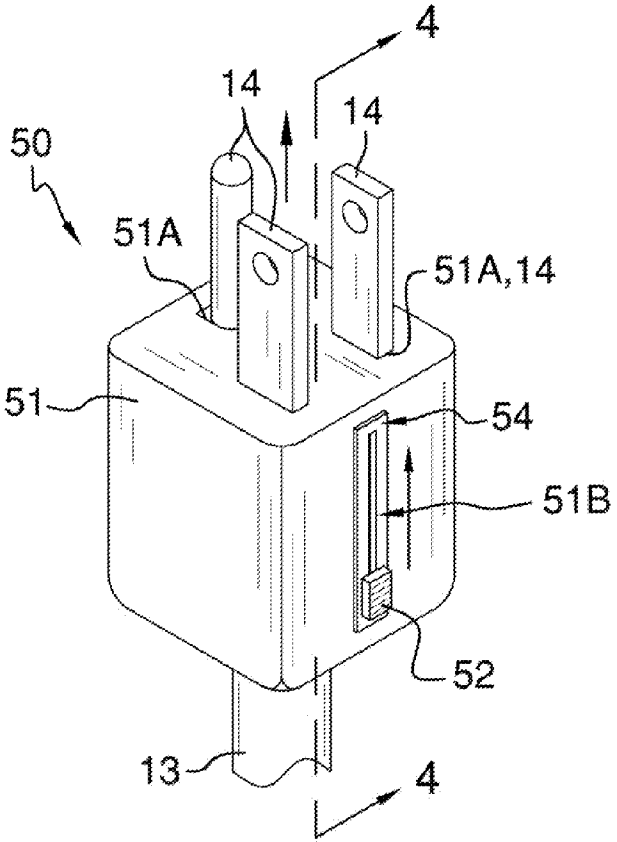
FIG. 2 illustrates an isometric view of a sliding tab embodiment of the invention wherein upon movement of the sliding tab up or down the side of the cover, the prongs will extend or retract from or into the cover.
Figure 4B:
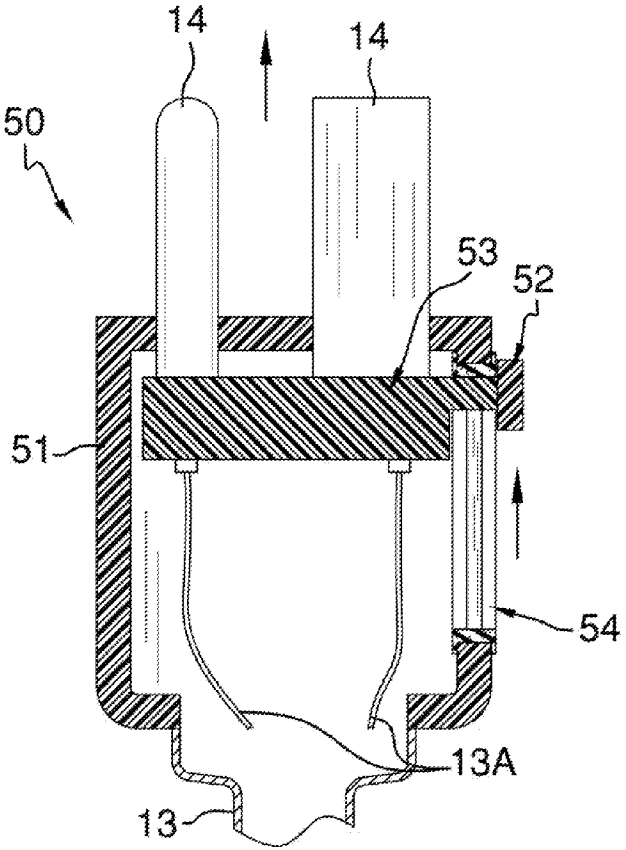
FIG. 4B illustrates a cross-sectional view of the sliding tab embodiment in FIG. 2, and depicting the prongs in an extended state wherein the sliding tab is pushed up.
Figure 4A:
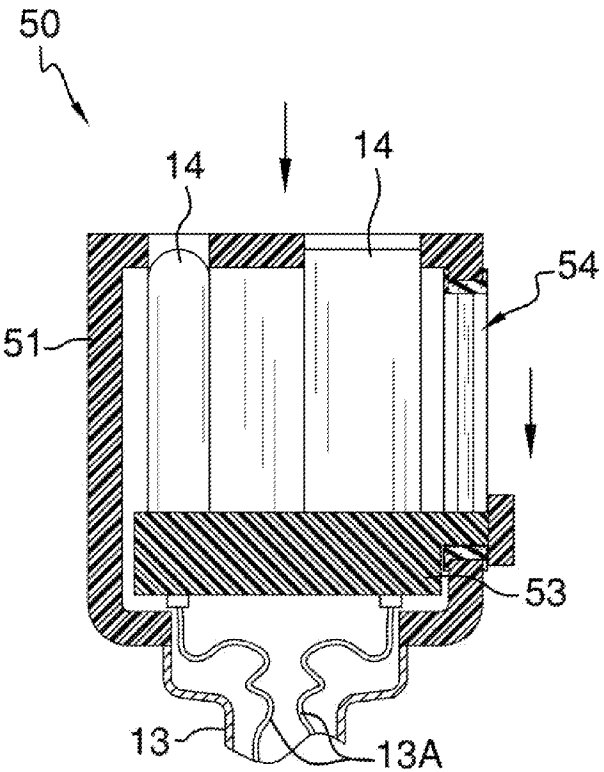
FIG. 4A illustrates a cross-sectional view of the sliding tab embodiment in FIG. 2, and depicting the prongs in a retracted state wherein the sliding tab is pulled back.

Referring to FIGS. 2, 4A, and 4B, a sliding tab embodiment 50 includes a housing 51, a sliding tab 52, a rubber seal 54, an electrical cord 13, and a plurality of electrical prongs 14 (hereinafter prongs).

It is important to note that the electrical prongs 14 are in electrical connection with the electrical cord 13 via individual wires 13A that run from the respective prong 14 and of which travel the length of the electrical cord 13.

The housing 51 is of hollow construction and contains therein a mounting plate 53. The prongs 14 are connected to the mounting plate 53, and both the prongs 14 and the mounting plate 53 are capable of vertical movement from within the housing 51. However, it shall be noted that the prongs 14 can extend and retract from the housing 51 via holes 51A that align and correspond with the prongs 14.

The sliding tab 52 is mounted about a side of the housing 51, which is located outside of the housing 51, and is capable of translational movement about an elongated opening 51B located on said housing 51. The sliding tab 52 is secured to the mounting plate 53 or is a single piece construction involving both pieces. As the sliding tab 52 is moved up or down the elongated opening 51B, the mounting plate 53 moves back and forth from within the housing 51, and thus propels the prongs 14 in and out of the housing 51.

Referring to FIG. 2, when the sliding tab 52 is pushed forward, the prongs 14 are extended out of the housing 51. Whereas, when the sliding tab 52 is pulled back, the prongs 14 are retracted into the housing 51.

The rubber seal 54 is located on the elongated opening 51B, and is designed to seal off the interior of the housing 51 from outside debris. The rubber seal 54 creates a waterproof environment within the housing 51, which is ideal so as to prevent an electrical short across the prongs 14.

The housing 51, the sliding tab 52, and the mounting plate 53 are made of a material comprising a metal, plastic, carbon fiber composite, or a wood.

It shall be noted that the twisting embodiment 10 and the sliding tab embodiment 50 can be integrated into the design of a new electrical cord or as an after-market product that is installed upon an existing electrical cord.

With respect to the above description, it is to be realized that the optimum dimensional relationship for the various components of the twisting embodiment 10 and the sliding tab embodiment 50, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the twisting embodiment 10 and the sliding tab embodiment 50.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. An improved electrical plug comprising:

wherein an electrical plug includes male prongs that are used to plug into a standard wall outlet, and wherein said prongs can extend and retract within a housing via actuating means;

wherein the actuating means includes a twisting function further defined by a top housing, a bottom housing, an electrical cord, and the male prongs;

wherein the top housing has a chamber that extends to within the bottom housing;

wherein the bottom housing can rotate about both the top housing and the chamber of the top housing;

wherein the male prongs are mounted onto upon a mounting plate that is located within the top housing and the bottom housing;

wherein the mounting plate has a female member including internal threading that corresponds with external threading of a spiraling screw that is located within and connected to the bottom housing.

2. The improved electrical plug as described in claim 1 wherein the housing is made of a material comprising a metal, wood, plastic, or carbon fiber composite.

3. The improved electrical plug as described in claim 1 wherein the improved electrical plug is integrated into the design of a new electrical cord or as an after-market product that is installed upon an existing electrical cord.

4. The improved electrical plug as described in claim 1 wherein the top housing and the bottom housing are both cylindrical in shape.

5. The improved electrical plug as described in claim 1 wherein the top housing, the bottom housing, the mounting plate, the female member, the spiraling screw, and the chamber are made of a material comprising a metal, plastic, carbon fiber composite, or a wood.

6. The improved electrical plug as described in claim 1 wherein wires move up and down with the mounting plate and extend and retract into the chamber.

7. The improved electrical plug as described in claim 1 wherein the mounting plate has a limited range of movement defined by inner surfaces of the top housing.

8. The improved electrical plug as described in claim 1 wherein the mounting plate and the female member move in unison, cannot rotate at all, and are capable of vertical movement inside of both the top housing and the bottom housing.

9. A means of using the improved electrical plug as described in claim 1 wherein as the bottom housing is rotated, the external threading of the spiraling screw enter and exit from internal threading of the female member, which causes vertical movement of the mounting plate, and thus extends or retracts the prongs from the top housing.

* * * * *